US005503606A

United States Patent [19]

Stephens

[11] Patent Number: 5,503,606

[45] Date of Patent: Apr. 2, 1996

[54] TRAINING APPARATUS

[76] Inventor: Thomas E. Stephens, 407 S. Alpine Dr., Liberty Lake, Wash. 99019-9729

[21] Appl. No.: 822,423

[22] Filed: Jan. 17, 1992

[51] Int. Cl.[6] ..... A63B 69/00

[52] U.S. Cl. ..... 482/7; 482/83; 482/86; 482/87

[58] Field of Search ..... 482/7, 83, 86, 482/87; 273/55 A, 55 R; 446/227

[56] References Cited

U.S. PATENT DOCUMENTS

| | | | |
|---|---|---|---|
| 827,596 | 7/1906 | Wood | 482/86 |
| 2,186,403 | 1/1940 | Bullis et al. . | |
| 2,197,545 | 4/1940 | Bachman et al. . | |
| 2,909,370 | 10/1959 | Fortney . | |
| 3,250,533 | 5/1966 | Nicholson . | |
| 3,337,217 | 8/1967 | Cummins . | |
| 3,384,372 | 5/1968 | Dickens | 273/55 A |
| 3,398,953 | 8/1968 | Thompson | 482/83 X |
| 3,424,458 | 1/1969 | Hopps, Jr. | 273/55 R |
| 3,680,861 | 8/1972 | Schmidt | 273/55 R |
| 3,699,704 | 10/1972 | Hakim | 446/227 |
| 3,804,406 | 4/1974 | Viscione . | |
| 4,103,889 | 8/1978 | Lobur | 482/86 |
| 4,564,192 | 1/1986 | Lebowitz . | |
| 4,807,871 | 2/1989 | Bryson . | |
| 4,819,934 | 4/1989 | Wilson et al. . | |
| 5,048,822 | 9/1991 | Murphy | 482/87 X |

FOREIGN PATENT DOCUMENTS

| | | | |
|---|---|---|---|
| 46210 | 3/1966 | Germany . | |
| 1063424 | 12/1983 | U.S.S.R. . | |
| 1251936 | 8/1986 | U.S.S.R. . | |
| 1681872 | 10/1991 | U.S.S.R. | 482/83 |

*Primary Examiner*—Richard J. Apley
*Assistant Examiner*—Glenn E. Richman
*Attorney, Agent, or Firm*—R. Reams Goodloe, Jr

[57] ABSTRACT

Apparatus and method for the inspection of training in the martial arts. A simple, computer programable apparatus and method is provided for increasing training efficiency of athletes. The device may vary speed and direction to vary the rhythm and cadence of an athlete, and is capable of fast or slow speeds to keep pressing the athlete to operate at the limits of his aerobic conditioning.

19 Claims, 13 Drawing Sheets

TRAINING APPARATUS

TECHNICAL FIELD OF THE INVENTION

This invention relates to methods and apparatus for training in the martial arts. More specifically, disclosed and claimed herein are methods and apparatus for highly effective technical and aerobic training for athletic endeavours such as boxing. The novel apparatus disclosed herein provides an automated opponent for a boxer that never tires, and operates as quickly as the boxer is able to keep up. A primary use for the invention is for the preparation of boxers for a major boxing match, such as a heavyweight championship.

1. Background of the Invention

A wide variety of methods and apparatus are known for enhancing the training efficiency of martial arts athletes such as boxers. However, most apparatus involves a simple one-on-one technique that does not force the athlete to move repeatedly, or to vary his cadence, or to keep up with a tireless opponent. As a result, most training methods currently in use do not proved a high degree of efficiency in training to achieve technical excellence and aerobic conditioning. Consequently, the available apparatus has not come into widespread use.

Another problem might be that apparatus is entirely repetitive, i.e. does not have the capability to provide a different type of training at various times. In any event, it is important to note that mechanized training apparatus have evidently not provided the desired combination of technical accuracy, strength training, and aerobic conditioning necessary to succeed in strenuous, technical sports such as boxing.

From the foregoing, it is clear that there is a continuing need for an improved, specialized, effective, programable apparatus and training method to enable athletes to be brought into fight ready condition in a relatively short period of time. Also, the need exists for such method and apparatus to be of such quality and reliability so as to enable semi-skilled or unskilled personnel to confidently, accurately, and reliably carry out the training methods by operation of the apparatus.

2. The Prior Art

Martial art training apparatus which may have some features resembling those disclosed herein to some remote extent include those disclosed in the following U.S. Pat. Nos.: 2,186,404 issued Jan. 9, 1940 to Bullis et al. for *STRIKING BAG STAND AND ATTACHMENT*; 2,197,545 issued Apr. 16, 1940 to Bachman et al. for *FOOTBALL DUMMY*; 2,909,370 issued Oct. 20, 1959 to Fortney for *BOXING DUMMY*; 3,250,533 issued May 10, 1966 to Nicholson II for *SPARRING DEVICE*; 3,337,217 issued Aug. 22, 1967 to Cummins for *TACKLING DUMMMY WITH FREELY SUSPENDED FIBROUS CORE*; 3,804,406 issued Apr. 16, 1974 to Viscione for *KARATE FIGHTER*; 4,103,889 issued Aug. 1, 1978 to Lobur for *COLLAPSIBLE BAG FOR IMPACT ABSORBING ACTIVITIES AND METHOD OF MAKING*; 4,654,192 issued Jan. 14, 1986 to Lebowitz for *MARTIAL ARTS TRAINING APPARATUS AND METHOD*; 4,807,871 issued Feb. 28, 1989 to Bryson for SIDE KICK MACHINE; and 4,819,934 issed Apr. 11, 1989 to Wilson et al. for *AUTOMATED BOXING MACHINE.*

It is significant that none of the prior art devices identified above are concerned with the specific problem of providing a highly effective, computer controlled training apparatus. This problem is of significant interest to a wide variety of talented athletes today. Thus, a continuing need exists for training methods and equipment which can provide a high quality training regimen to adequately prepare athletes for important events.

SUMMARY OF THE INVENTION

I have developed superior training apparatus for developing strength, quickness and agility in the martial arts. More specifically I have developed a novel apparatus that provides unparalleled results as needed in preparation for boxing matches. Each of my training devices is set up to utilize a punching bag of my own design; that bag design has achieved an impact absorbing effect which enables the fighter to avoid nagging hand injuries so common when training utilizing known prior art devices.

My solution to providing an efficient automated training apparatus involves the use of a rotating wheel or ring which is supported by a suitable transport assembly or other holder or support structure. The support structure allows the ring to turn forward and backward at any desired speed as may be pre-programmed or hand selected. The wheel has spokes, to which are attached a pre-selected variety of bags of my design. Presently, I find it advantageous to utilize eight spokes in my wheel design, however, any desired number may be selected. In order to maintain a truly round wheel, a series of adjustable tension bars are provided. Attached to the spokes may be in excess of forty (40) bags. A range of sizes of bags may be provided to enable a boxer or other athlete to engage in a variety of maneuvers that simulate actual fight conditions.

In contrast to martial art training apparatus known to me that has been heretofore been commercially available, the novel apparatus and methods disclosed herein are adaptable to an fully programable, rapidly executable, and reliable training regemin. The apparatus and methods are suitable for use by skilled professionals, as well as less experienced fighters that desire to rapidly increase their technical proficiency and aerobic conditioning. Further, the method and apparatus of the present invention allows the training process to be practiced in a remote, specialized high quality gymnasium. Thus, training efficiency can be increased by way automatically repeating challenging and exhausting movement patterns.

By way of the present invention, I have developed novel apparatus and methods to solve the problem of providing a challenging opponent for the fighter in training. My novel solution to the problem of providing a high quality opponent eliminates the necessity to find a series of human opponents to constantly engage the training fighter. Moreover, my method and apparatus provide superior technical training efficiency and increased aerobic conditioning when compared to available devices and methods.

In short, I have developed novel methods and apparatus for fight training, particularly for technical improvement and for aerobic conditioning under fight conditions. The novel training apparatus includes a computer driven, programable, variable speed and variable direction rotating wheel which supports a plurality of impact absorbing bags In addition, I have developed simplified apparatus for developing, honing, and maintaining blinding hand speed while maintaining and focusing power and accuracy which is simply unattainable by way of presently used training devices known to me. Finally, I have developed a unique impact absorbing bag design which allows the benefits of traditional training, without the nagging hand injuries associated with prior art impact bag devices.

OBJECTS, FEATURES, AND ADVANTAGES OF THE INVENTION

It is an object of the present invention to provide methods and apparatus for training in the martial arts which improve speed, accuracy, and aerobic conditioning.

It is also an object of the present invention to provide training methods and apparatus which challenges athletes at all skill levels.

It is yet another object of the present invention to provide impact absorbing bags which are capable of taking repeated punches while maintaining their impact absorbing ability, thus avoiding nagging hand injuries by the user.

It is still another object of the present invention to provide a device and method which is easy for semiskilled workers to utilize for the purpose of providing training to athletes, such as may be encountered in a neighborhood gymnasium situation.

It is an important feature of the present invention that the speed and direction of my computerized, automated boxing ring may be varied to suit the skill and conditioning level of the user.

It is an important and primary feature of the present invention that it is easy and simple to operate, thus eliminating the need for highly trained personnel.

It is an important advantage of my invention that semiskilled workers can conduct training sessions inspections which can be more frequently and cost effectively completed so as to assist in reducing costs of training athletes such as boxers preparing for matches.

It is yet another important advantage that increased use of my inventions reduces or eliminates the need to find opponents of appropriate skill levels to engage the training athlete on a continuing basis.

Additional objects, advantages, and novel features of the invention will be set forth in the detailed description of the invention which follows, or may become apparent to the reader from the appended claims and accompanying drawings, or may be learned by practice of the invention. The objects and advantages of the invention may be realized and attained by means of the instrumentalities and combinations particularly pointed out in the appended claims, or by their equivalents.

BRIEF DESCRIPTION OF THE DRAWINGS

My invention may be more dearly understood by reference to the accompanying drawings thereof, wherein.

DETAILED DESCRIPTION OF THE INVENTION

Figure 1:
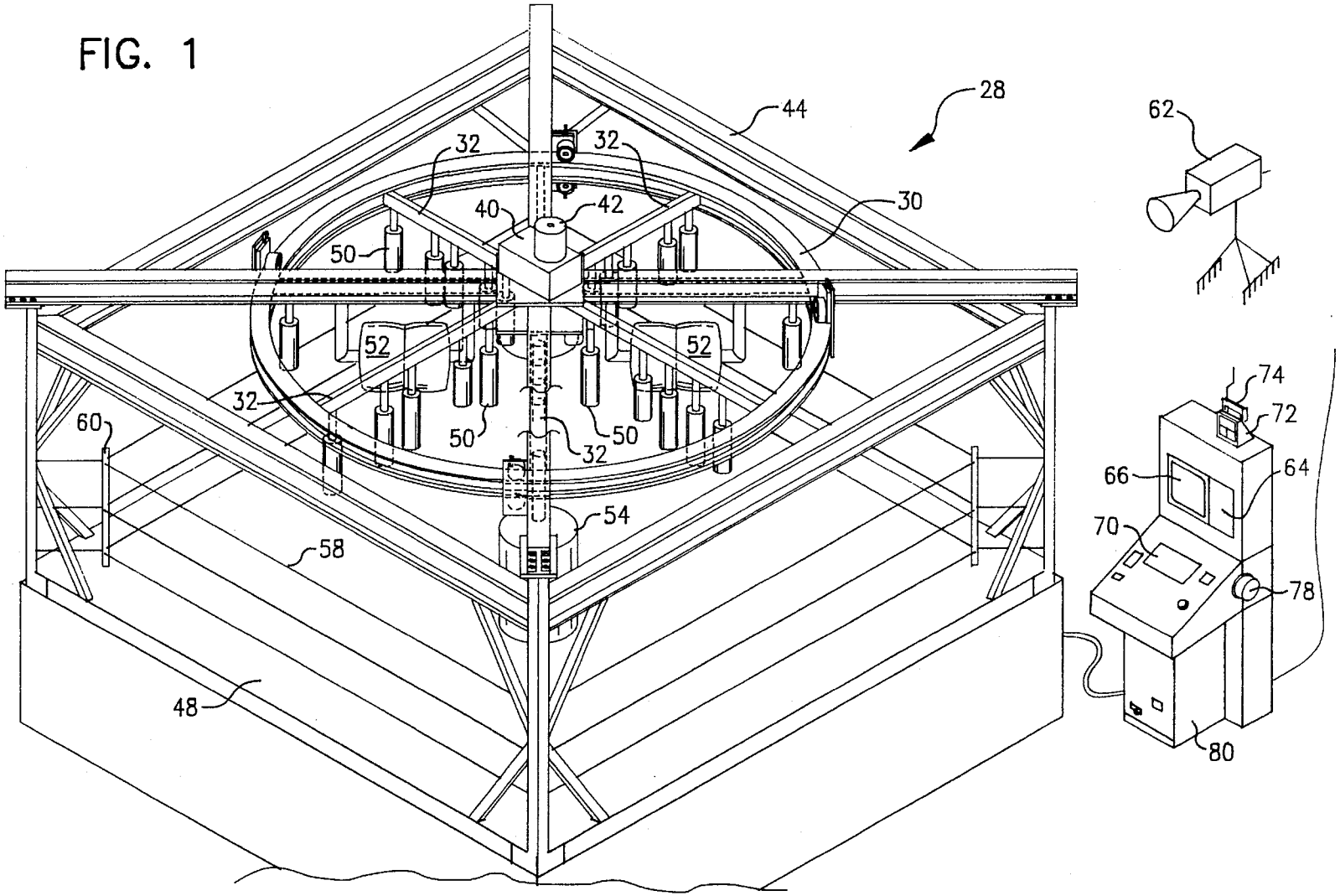
FIG. 1 is a perspective view of my computerized, programable training apparatus.
Figure 4:
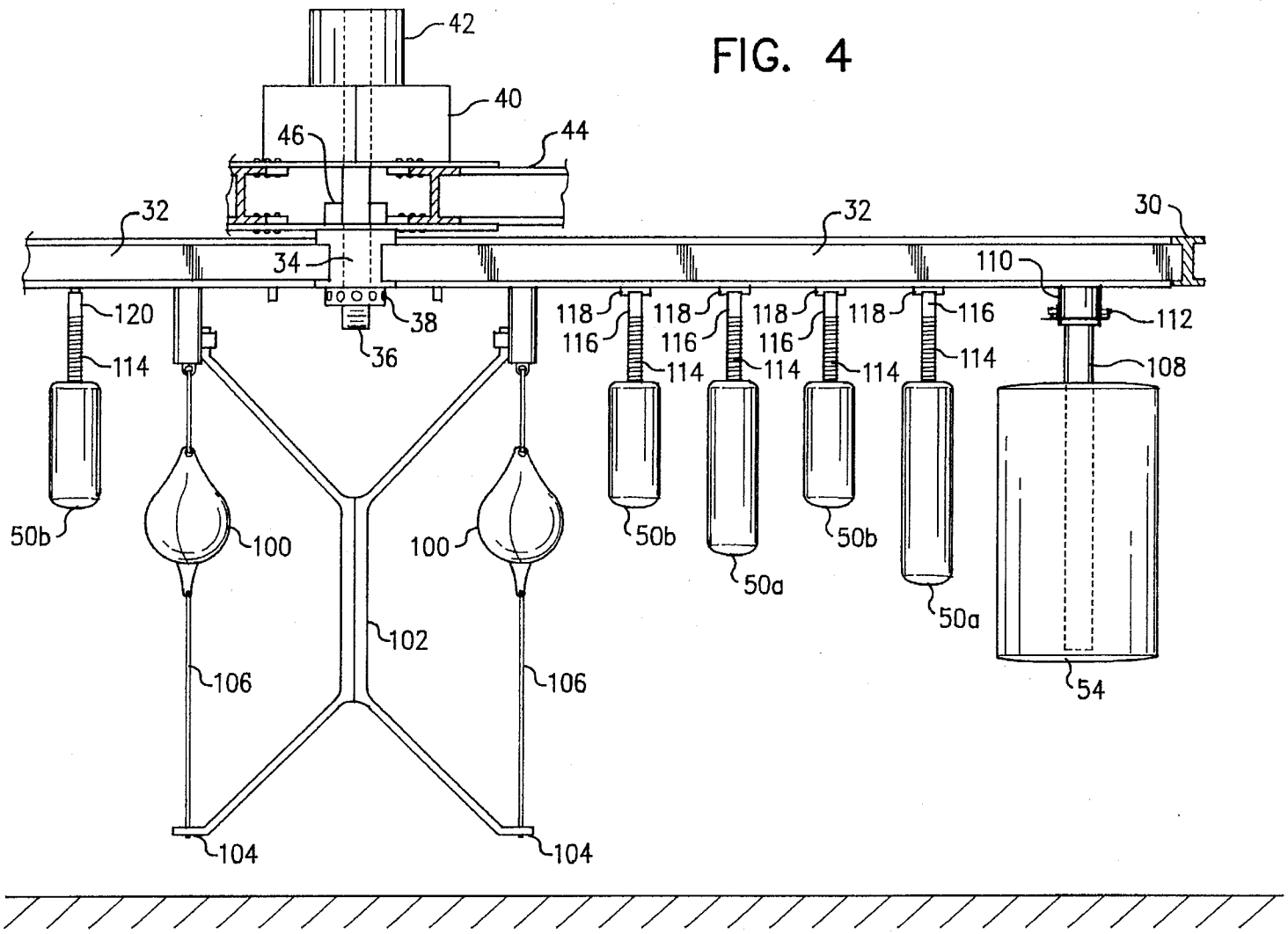
FIG. 4 is a side view of the intersection of two spokes of the rotating wheel of the programable training apparatus, showing at the right a cross section of the rail which forms the rotating wheel, and showing below the spokes various impact absorbing bags and their mounts.

Refer first to FIGS. 1 and 4 for purposes of providing an overview of my novel automatic training apparatus 28. Where in the drawing identical parts are shown, common numbers will be provided without further explanation as appropriate.

A rotating wheel 30 is provided having spokes 32 which join at a hub 34. Hub 34 is rotatably mounted on shaft 36, and is secured to shaft 36 by nut 38. Shaft 36 is connected to gearbox 40, which is in turn driven by a prime mover such as electric motor 42. The entire rotating wheel, including all steel of the wheel, the spokes, and other suspended parts, may weigh approximately 5000 pounds. This weight is suspended from a frame 44 via way of a specialized weight supporting bearing 46. Frame 44 is comprised of a variety of suitable support structure components which may be adequately appreciated from the drawing alone by those skilled in the art.

Frame 44 supports wheel 30 at a suitable height H above the mat 48, so that bags 50 may be at a suitable height for athlete 52 to punch small bags 50, uppercut bags 52, or large vertical bags 54. It should be noted that small bags 50 may be provided in various sizes, such as bags **50*a* or 50*b* as noted in FIG. 5. Returning now to FIG. 1, the ring 56 is provided at a suitable size to reflect actual ring conditions in a regulation match. I normally use a twenty foot (20') by twenty foot (20') size ring 56. The ring is provided with the usual ropes 58 and pads 60**.

The entire training of boxer 52 may be observed by video camera 62 and recorded by a video recorder 64 and shown on a video monitor 66 located at control console 68. Control console 68 also houses a programable computer control system 70. Also visible on control console 68 are the round counter 72, punch counter 74, and bell 78.

Figure 2:
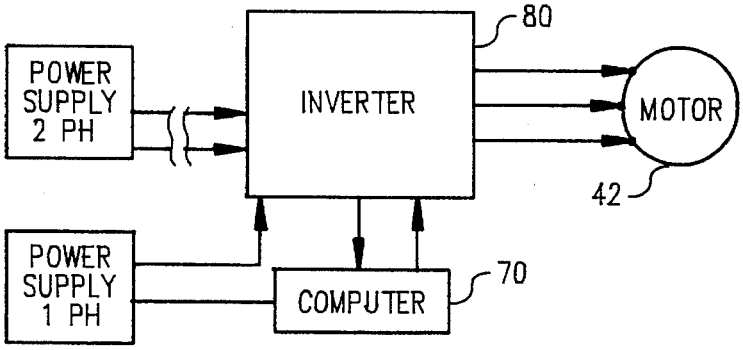
FIG. 2 is a block schematic of the electrical power supply system for the programable training apparatus first illustrated in FIG. 1.
Figure 3:
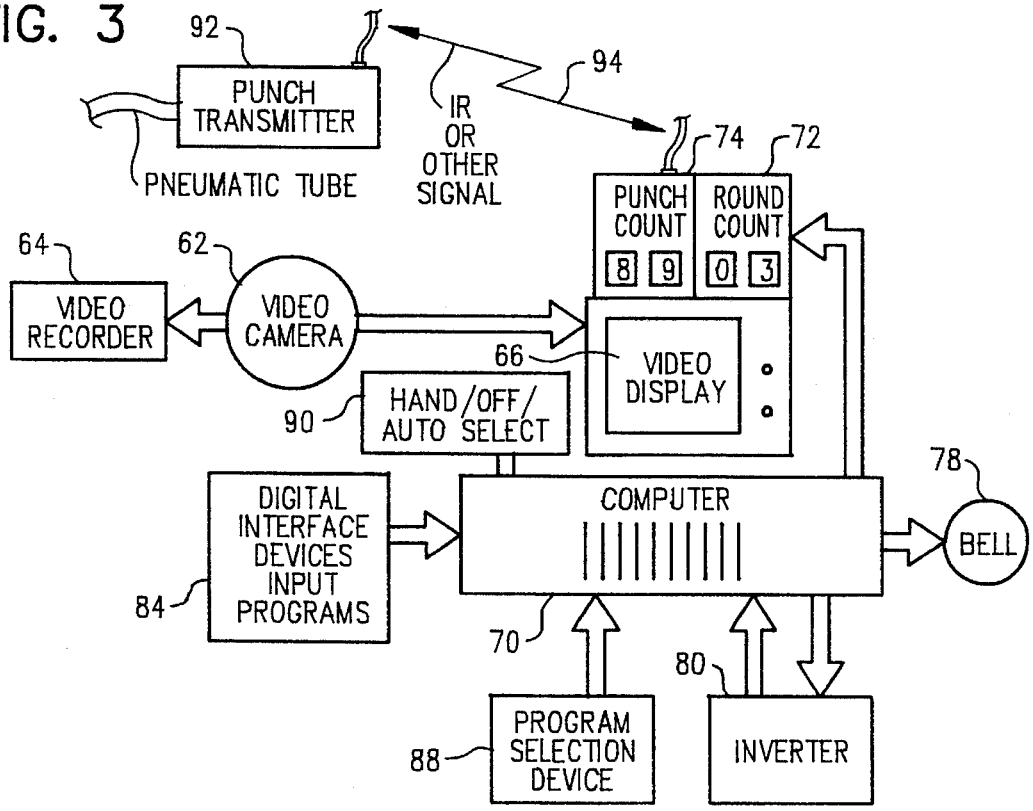
FIG. 3 is a schematic of the major functional devices that control and keep records in my programable training apparatus.

The electric motor drive controller/inverter 80 may also be conveniently located at the control console 68. Details of these important devices can be further evaluated at FIGS. 2 and 3. The motor controller/inverter 80 is an important part of my automated training apparatus 28. It is necessary to provide a variable speed drive to the apparatus 28 that is capable of stopping, changing direction, and accelerating and decelerating. Because I was faced with utilizing two (2) phase power to achieve the necessary variable speed operation, I have utilized a transistor inverter available under the name Tosvert-13061, available from Toshiba Houston. The computer 70 may be programmed with different input programs by way of digital input device 84 such as a tape drive or other media. Discrete input programs may be developed to suit the individual user with respect to variance in the ring speed. I normally allow up to about twelve (12) revolutions per minute, and set up various programs so that the boxer 52, will, at various times, have to run, walk, stand still, and walk or run backwards, in order to keep up with or avoid the varying targets provided by bags 50, 52, and 54. A selection device 88 can be provided to allow individualized user selection of a desired program sequence. If desired, manual control 90 can be utilized.

Rounds in a boxing match are normally set up for three (3) minutes per round, with one (1) minute rest between rounds. The computer 70 provides an update on the number of rounds by display at the round counter 72. Also, a some or all bags may be provided with a pneumatic or other desirable sensor system that detects when a punch is received by the bag. In a pneumatic system that I prefer, the pneumatic signal (an increase in air pressure in an air bladder—further described below) is transformed by a punch transmitter device 92 into an infrared signal 94 (or other suitable wireless signal) which is received at punch counter 74.

It should also be noted in that my rotating wheel 30 and spokes 32 are provided with bags 50, 52, and 54 which are attached by way of means to overcome the centrifugal force of the rotation of the wheel 30. This concept of holding the bag in place, in spite of the tendency to swing outward, is important. One method to hold conventional punching bags 100 in place is shown in FIG. 4. As can be seen, this requires a frame 102 with feet 104, and as well as tether 106. Without the tether, the bag 100 would fly outward during rotation of the ring.

Figure 7:
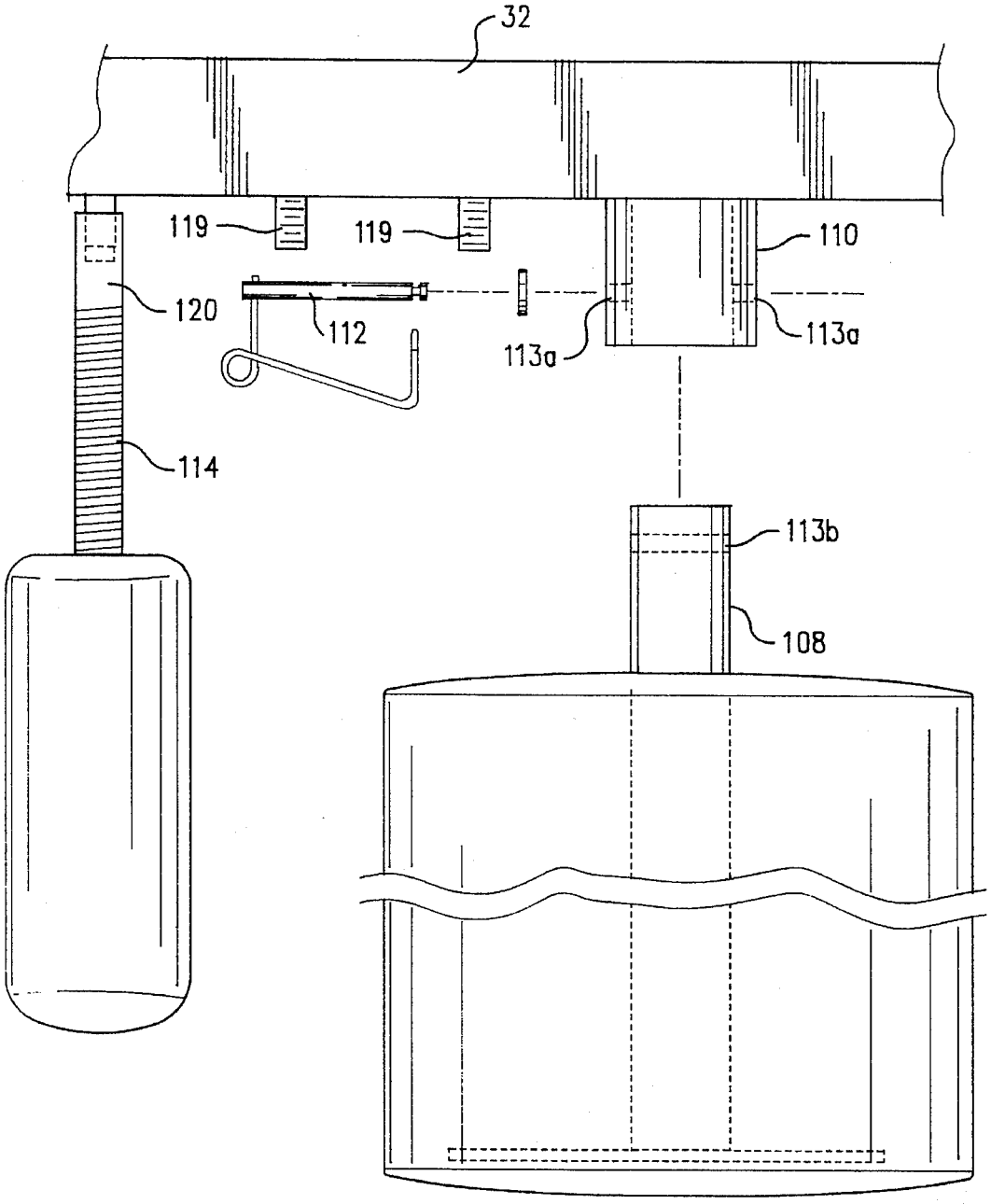
FIG. 7 is a side view of various mounting devices which may be utilized for attaching my impact absorbing bags to the spokes of the wheel of my programable training apparatus.

I have provided bags with either a stiff spring and fastener method, or with a directly coupled method, in the case of large bags 52 and 54. The large bags 52 and 54 have pipe 108 cores which can be inserted in sleeves 110 and pinned 112 in place at locating holes **113*a* and 133*b*. In the case of the smaller bags with springs 114, an insert 116 is welded to springs 114, and the insert is connected to block 118 which is in turn welded to spoke 32. Alternately, a threaded shaft 119 (See FIG. 5) can be provided at spoke 32. A threaded sleeve 120 is welded to spring 114, and then the sleeve 120 is fastened to shaft 118. For further detail, the reader is referred to FIG. 7**.

Figure 5:
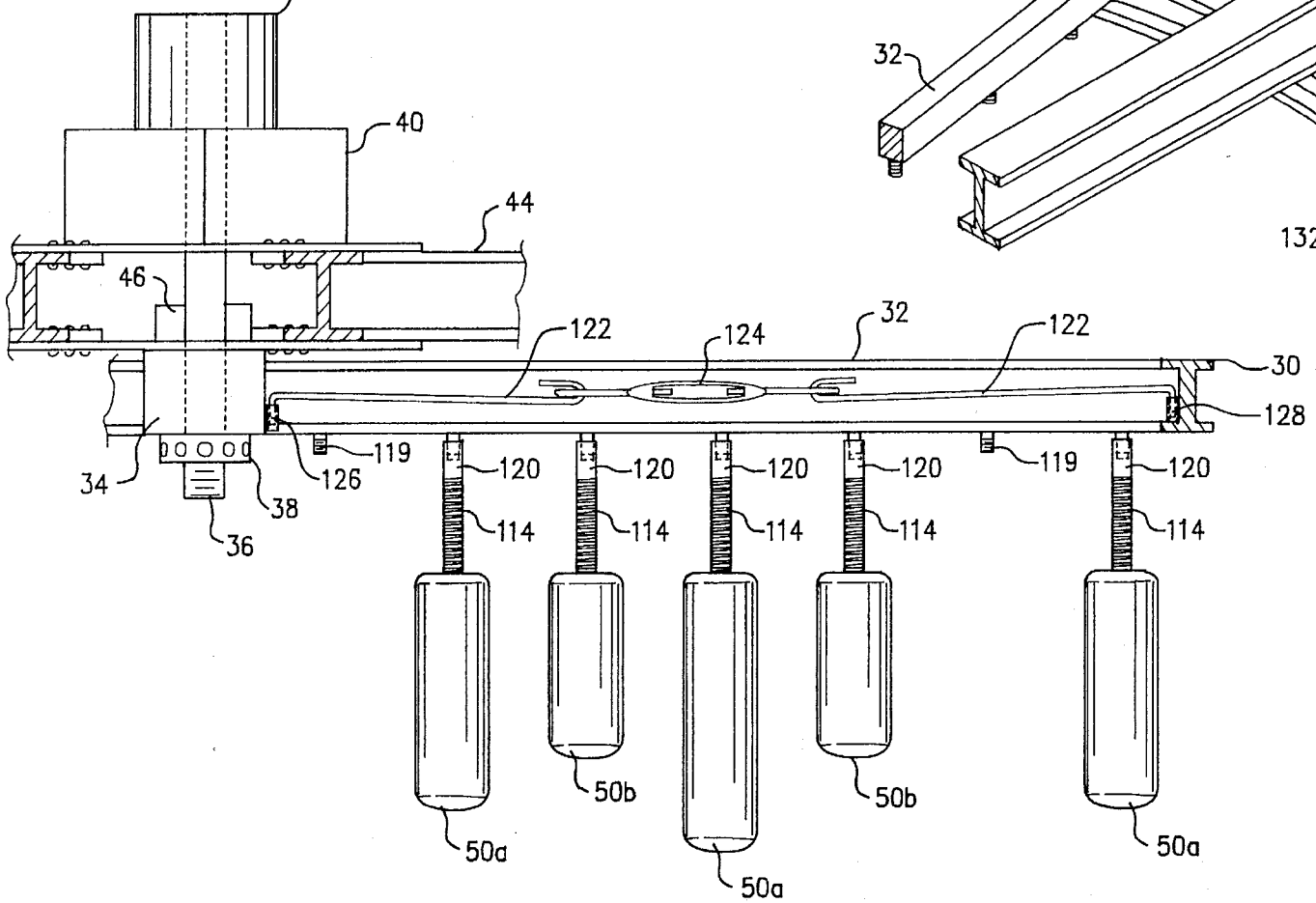
FIG. 5 is a further side view of a spoke of the rotating wheel of the programable training apparatus, showing the central hub, drive shaft, gear box, and motor locations, as well as the adjustable tension stay running between the hub and the perimeter of the wheel.

Turning now to FIG. 5, the stay rod 122 is shown with adjustable turnbuckle 124. I prefer to provide one stay rod 122 between each spoke 32. The rods 122 and adjustment to turnbuckle 124 are used for the purpose of trueing up the wheel 30 and keeping it circular as the loads provided by suspended bags is changed on wheel 30. Normally, the hub end of rod 122 is secured in a locating sleeve 126 which is welded to hub 34, and the wheel 30 end of rod 122 is secured in a locating sleeve 128 which is welded to the wheel 30.

Figure 6:
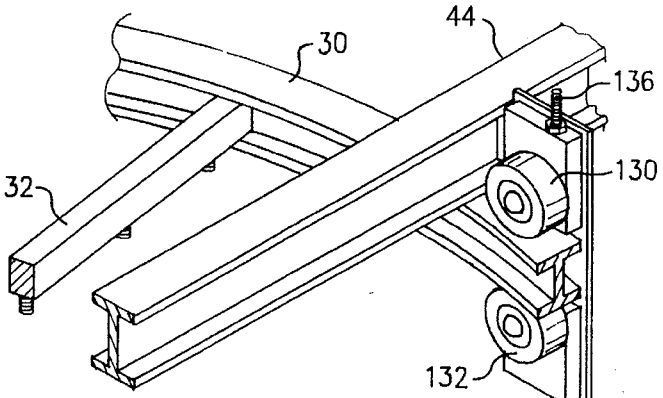
FIG. 6 shows in perspective the guide wheel arrangement that provides additional support to the rotating wheel.

Turning now to FIG. 6, upper 130 and lower 132 guide wheels are shown attached to frame 44 via way of guide attachment plate 134. The vertical location of guide wheels 130 and 132 may be changed via way of upper 136 and lower 138 adjusting bolts, respectively. The guide wheels 130 and 132 are not normally weight bearing; however, they do serve a safety function and may bear weight as necessary. They also serve as an indicator of the vertical trueness of the wheel 30, so give an indication of when adjustment of stay rods 122 need adjustment.

Figure 8:
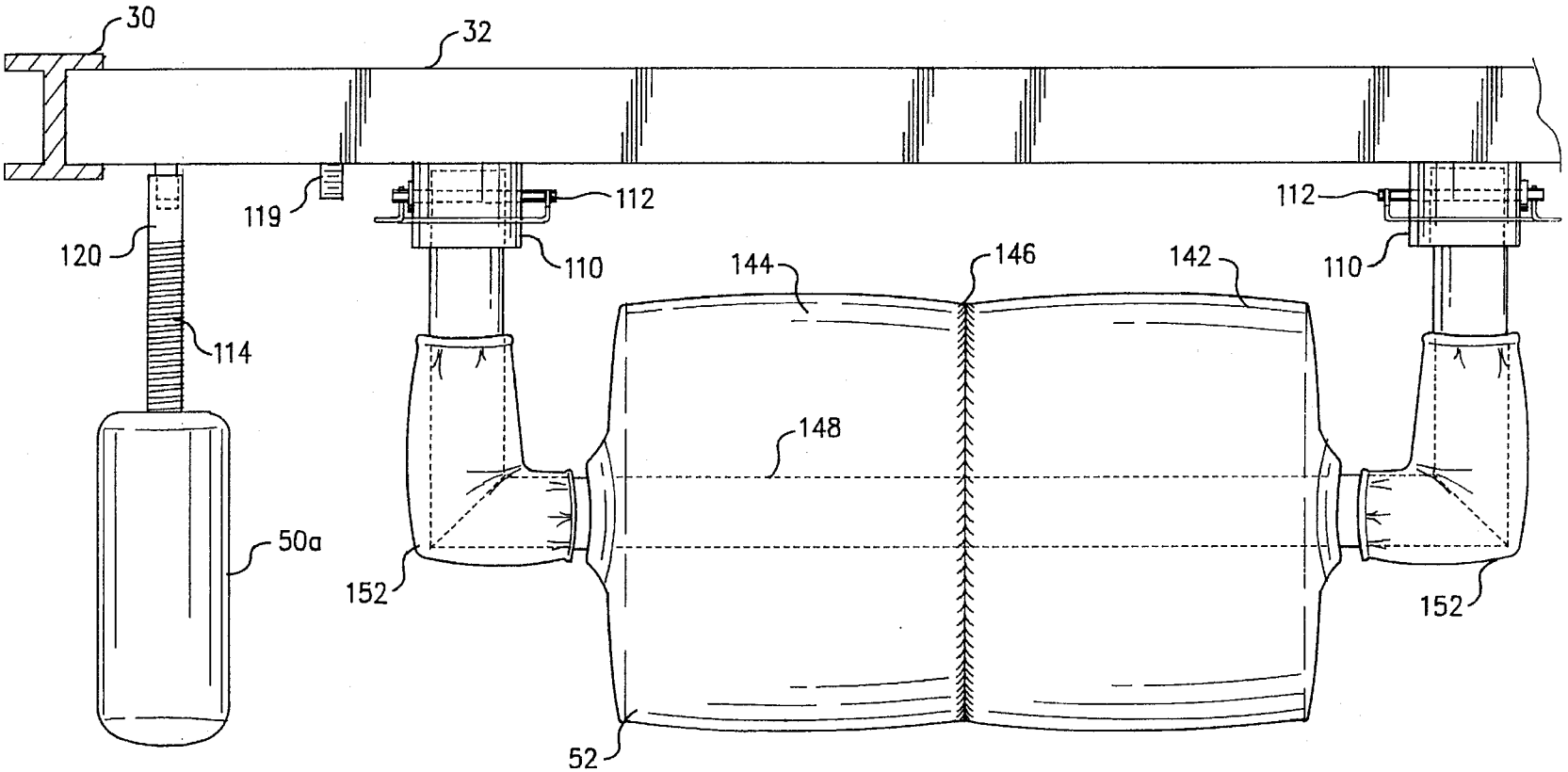
FIG. 8 is a side view of additional embodiments of my impact absorbing bags, also showing devices for mounting of same.

Referring now to FIG. 8, an uppercut bag 52 is shown attached to spoke 32. Note that the attachment sleeve 110 and locking pin 122 is interchangeable with the attachment used by vertical bag 54. A leather cover 140 is provided in parts 142 and 144 for the uppercut bag 54. The parts 142 and 144 are joined at sewn seam 146. The bag has a central pipe 148 but otherwise is constructed similar to the design shown for the bag depicted in FIG. 11. below. In order to protect the the boxer 52, the elbows 150 of pipe 148 are provided with pads 152.

Figure 9:
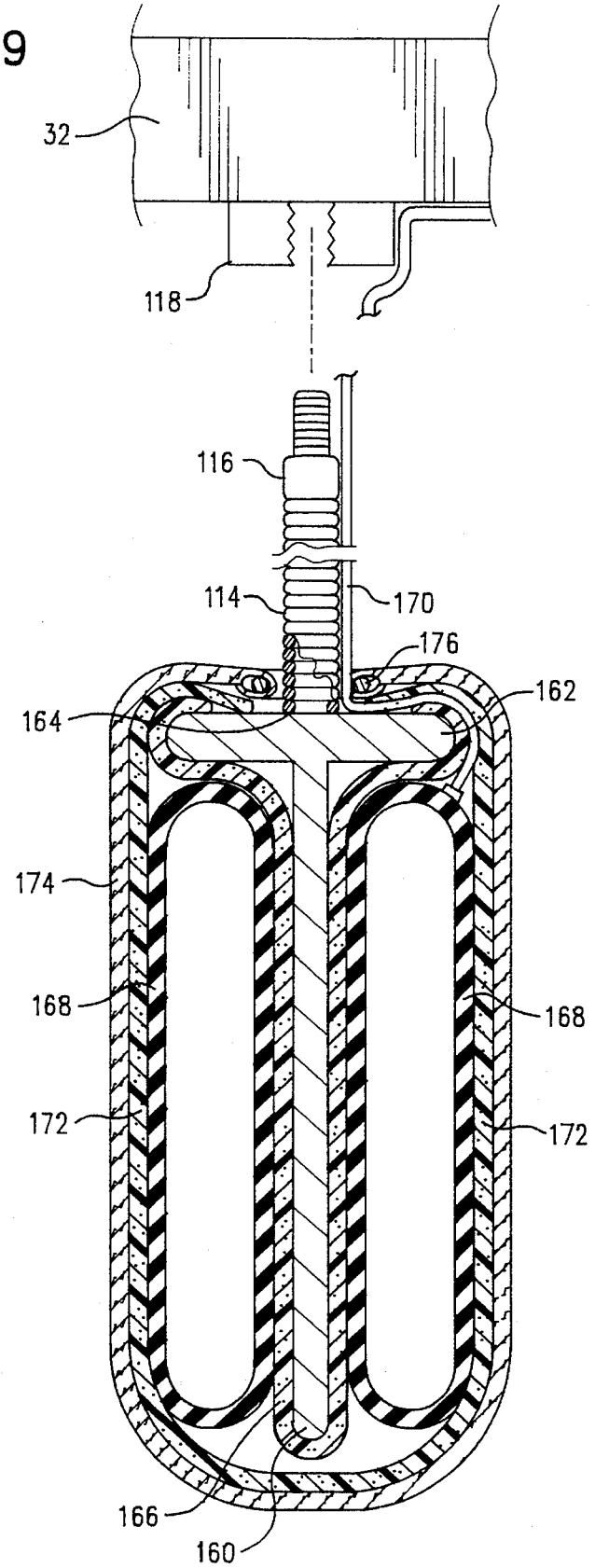
FIG. 9 is a cross-sectional view of one type of my impact absorbing bags,showing the internal air bladders which are surrounded by impact absorbing foam and covered by leather, as well as illustrating the pneumatic tube which runs from the air bladders to a punch counter located elsewhere on the wheel.
Figure 10:
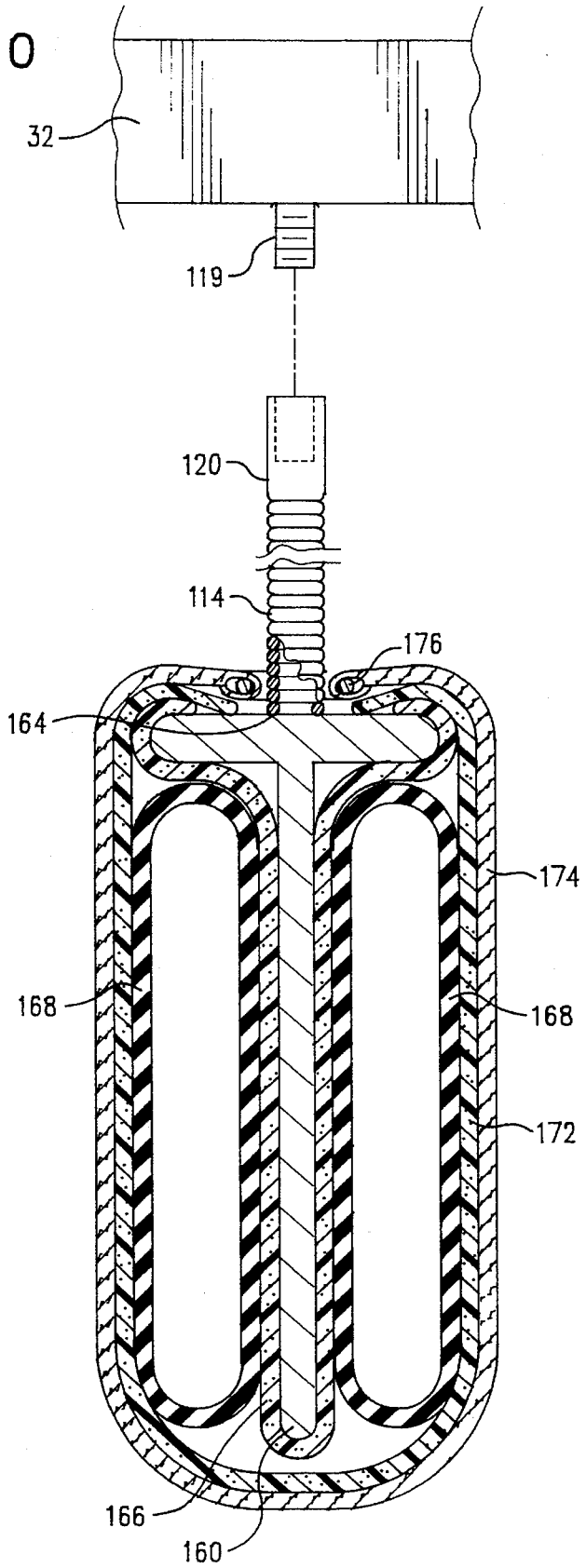
FIG. 10 is a cross-sectional view of a second embodiment of my impact absorbing bag which utilizes a slightly different attachment method.

Turning now to FIG. 9, a small bag 50, such as bag **50*a* or 50*b* is illustrated in cross-section to show the impact absorbing components. A central rod 160 with circular flange 162 is provided as a core. Spring 114 is attached to flange 162 at the bottom 164 of spring 114. A layer 166 of high density dosed cell foam such as polyurethane or polypropylene is provided next to rod 160. Then, vertical air bladders 168 are provided around the rod 160. For the smallest bags 50*b* that I currently make, two bladders are provided four bladders are provided in the slightly larger size. For use with the punch counting system (transmitter 92 and receiver 740, a pneumatic tube or line 170 is provided to transmit air pressure to transmitter 92. An outer layer 172 of high density closed cell foam is provided for additional protection and punch dampening effect. An outer layer of high grade leather 174 is provided to complete the bag. The leather may be secured by way of tie-string 176. As to FIG. 10**, essentially the same elements are depicted with a different suspension system.

Figure 11:
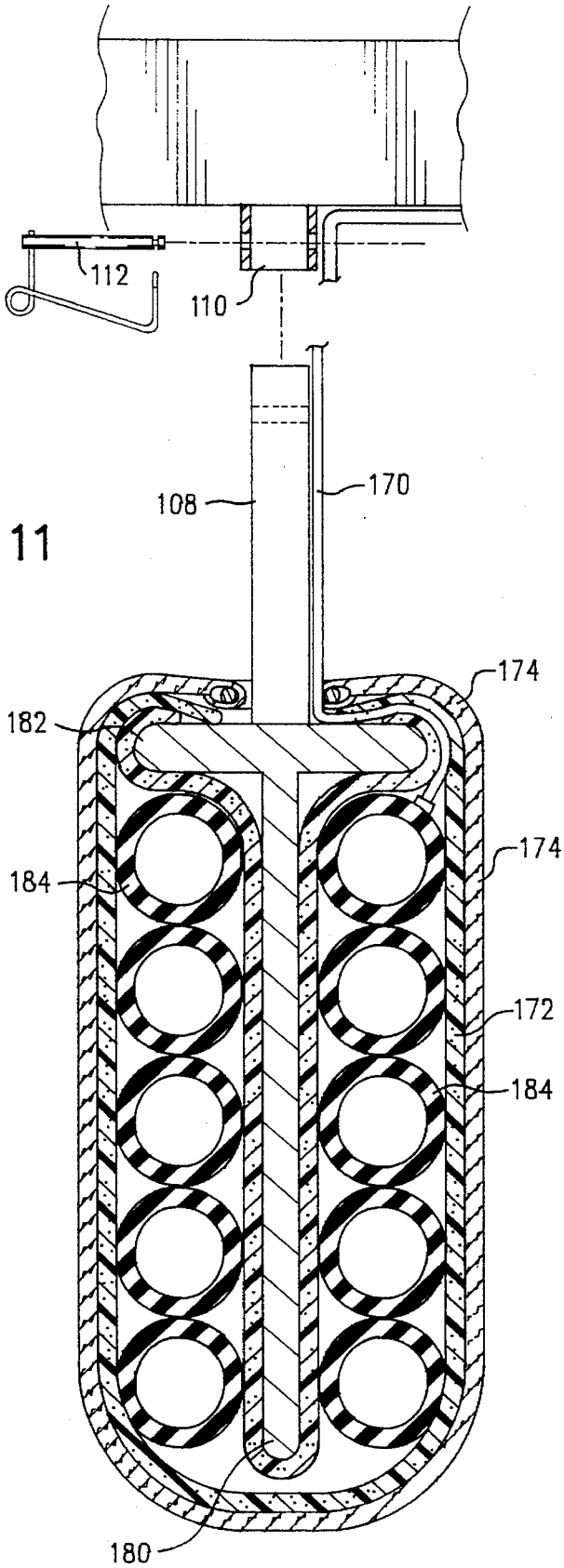
FIG. 11 is a cross-sectional view of a third embodiment of my impact absorbing bag, this time using horizontally disposed rather than vertically disposed air bladders.

FIG. 11 shows a large vertical bag such as bag 54. In these bags, a central core rod or pipe 180 is provided. A circular flange 182 is located at the top, to which a pipe section 108 is attached. Note, however, that the air bladders 184 are provided in a horizontally disposed fashion. In other respects, the bag 54 uses high density foam as described above, and includes a leather cover 174.

A training method utilizing the above described apparatus 28 forces the kind of movement that a fighter actually encounters in the ring. The method specifically addresses the timing, rhythm, distance, cadence, etc., necessary to avoid objects or to close in your distance against an objects.

Figure 12:
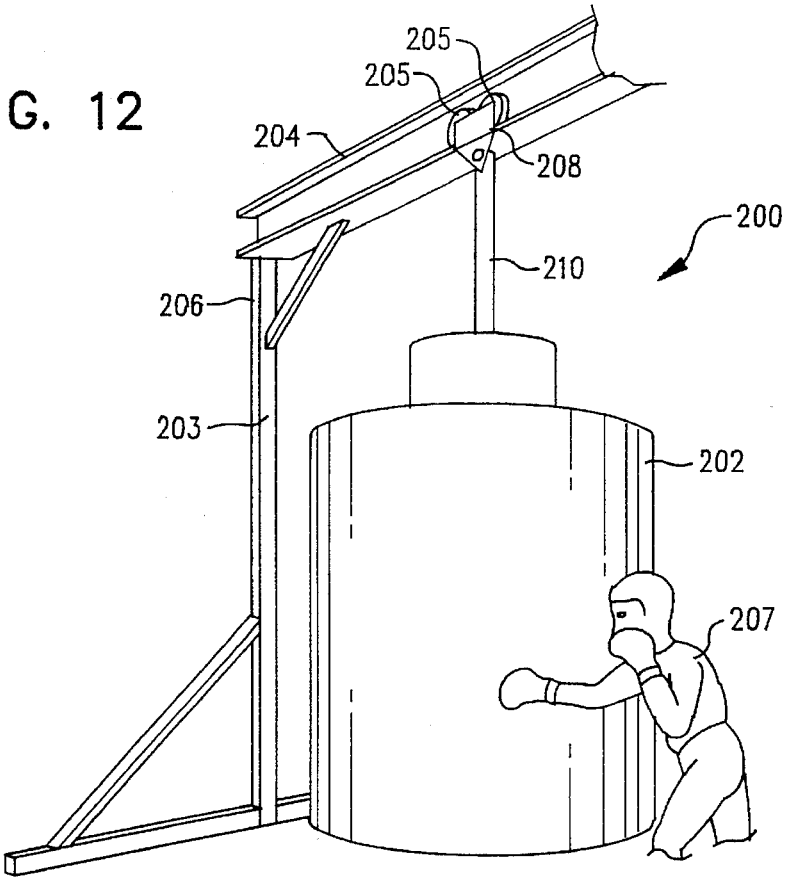
FIG. 12 is a perspective view of my strength training apparatus, here shown utilizing a large impact absorbing bag.
Figure 13:
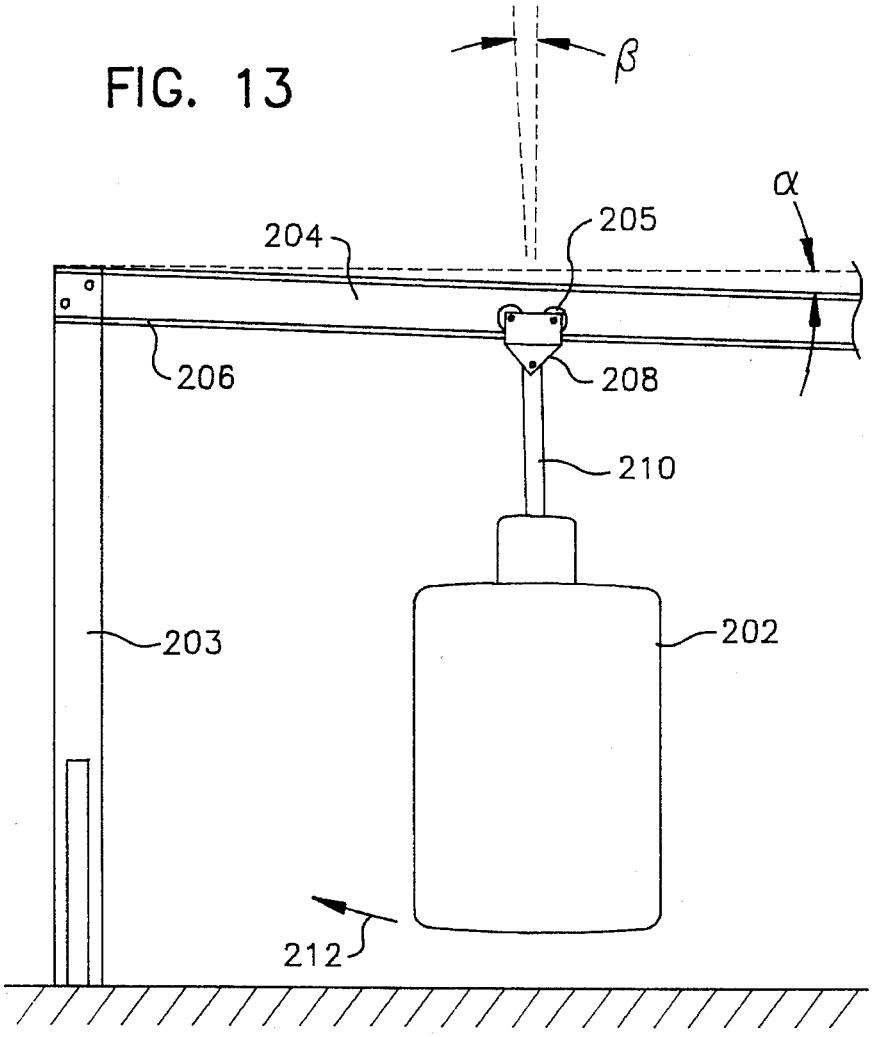
FIG. 13 is a side view of my strength training apparatus, here illustrating key design parameters that challenge the athlete, including slope of the travelling rail and angle of bag presentation.
Figure 18:
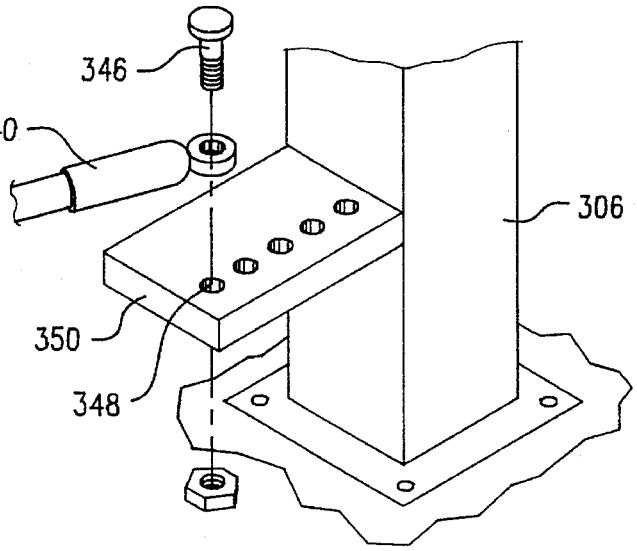
FIG. 18 is a perspective view of a portion of the speed and accuracy training apparatus first illustrated in FIG. 15, showing the adjustment device provided for changing the angle of the shock absorbing attachment.
Figure 15:
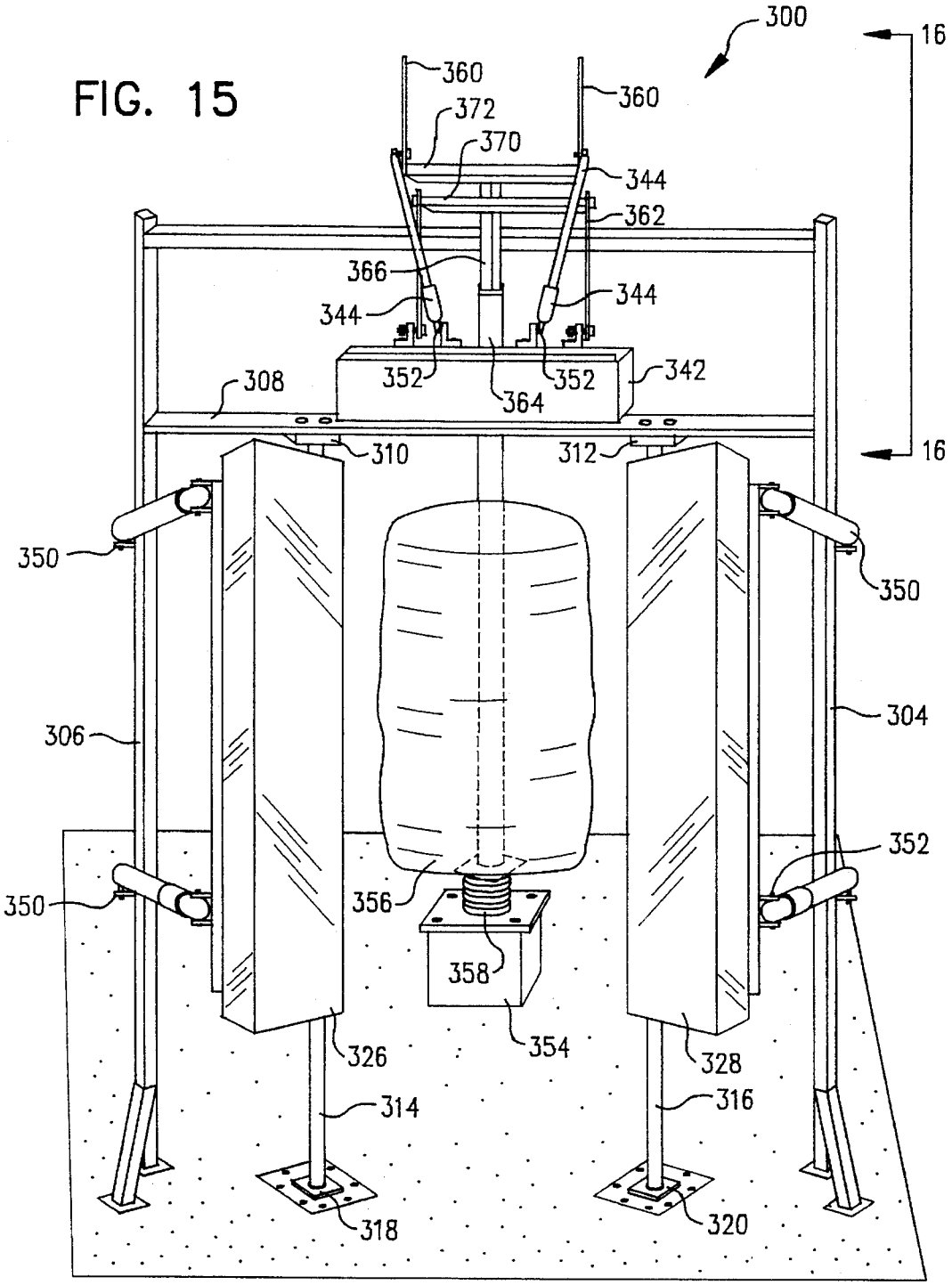
FIG. 15 is a perspective view of a speed and accuracy increasing training apparatus this apparatus utilizes an impact absorbing bag construction similar to that shown in FIG. 14, but with support from the bottom rather than the top.

FIG. 12 illustrates my strength training apparatus 200. A large bag 202 weighing about 2000 pounds is provided. Support means 203 such as a post support the support rail 204. Boxer 206 can punch bag 202 and with sufficient strength move bag 202 along rail 204 via way of rollers 205 towards the rear 206. However, in FIG. 13, it is seen that rail 204 is inclined upward by an angle alpha ($\alpha$) of about three degrees, to increase the amount of work necessary. Also, bag 202 is oriented toward boxer 207 by an angle beta ($\beta$) of about seven to ten degrees by way of suspension means 208 and suspension rod 210, so that the bag 202 tends to rock in the direction of arrow 212 rather than move along rail 204.

Figure 14:
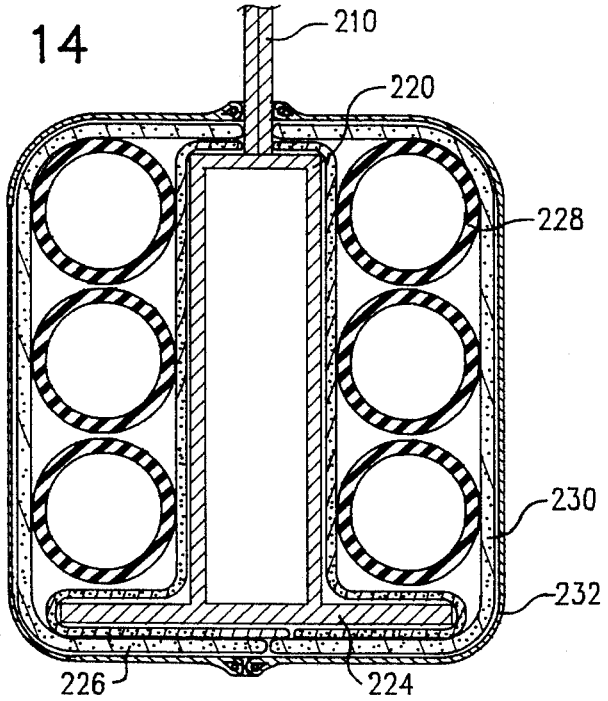
FIG. 14 is cross-sectional view of the large impact absorbing bag first shown in FIG. 13, now revealing the details of impact absorbing construction.

Turning now to FIG. 14, construction of bag 202 is shown. The bag has a central pipe core 220 into which additional weight such as sand 222 or shot can be added if desired or necessary. A bottom flange 224 is welded to core 220. A layer of dosed cell foam 226 is provided to cover the pipe 220 and flange 224. Air bladders 228 such as inner tubes are provided Additional closed cell foam layer 230 then covers the air bladders 228. Then, a leather covering 232 is provided.

The heavy bag's function is to develop power. You need to move something heavy in order to move something. The bag as shown may be about 2000 pounds. Driving it up an incline, approximately a 3° up slope. Also, it is tilted toward the fighter, approximately seven to ten degrees.

Now, turning to FIGS. 15 through 19, my strength and technical conditioning apparatus 300 will be described. This strength and technical conditioning apparatus 300 allows development of various punches, such as the left hook, the right hook, the uppercut, straight right, and the straight left.

A frame 302 is provided having vertical side members 304 and 306. A cross bar 308 supports bearings 310 and 312. Rods 314 and 316 run vertically from bearings 310 and 312 respectively to lower bearings 318 and 320 respective. Rods 314 and 316 have a welded thereto support plates 322 and 324. Plates 322 and 324 support left shock absorbing panel 326 and right shock absorbing panel 328 respectively, which are secured by appropriate fastening means 329. In response to a punch thrown by boxer 330, shock absorbing panels pivot on rods 314 and 316. Shock absorbers 340 are provided at the panels 326 and 328 to absorb the punch. Similarly, at upper panel 342, shock absorbers 344 are provided to absorb the shock. The angle of panels 326 and 328 may be adjusted by way of moving pins 346 to various locating positions 348 on support plate 350. Hinged brackets 352 secure shock absorbers 340 and 344 to the shock absorbing panels.

Pedestal 354 supports bag 356 via way of spring 358. The bag 356 is similar to bag depicted in FIG. 11 above, only inverted.

Figure 16:
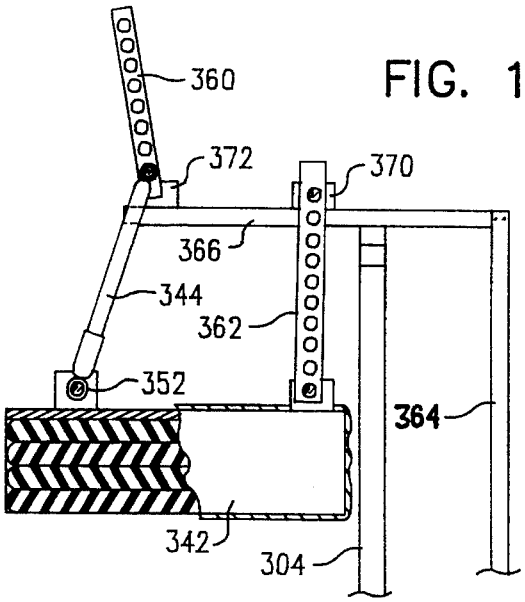
FIG. 16 is a side view in partial cross-section showing the attachment methods of the top panel of my speed and accuracy training device.
Figure 17:
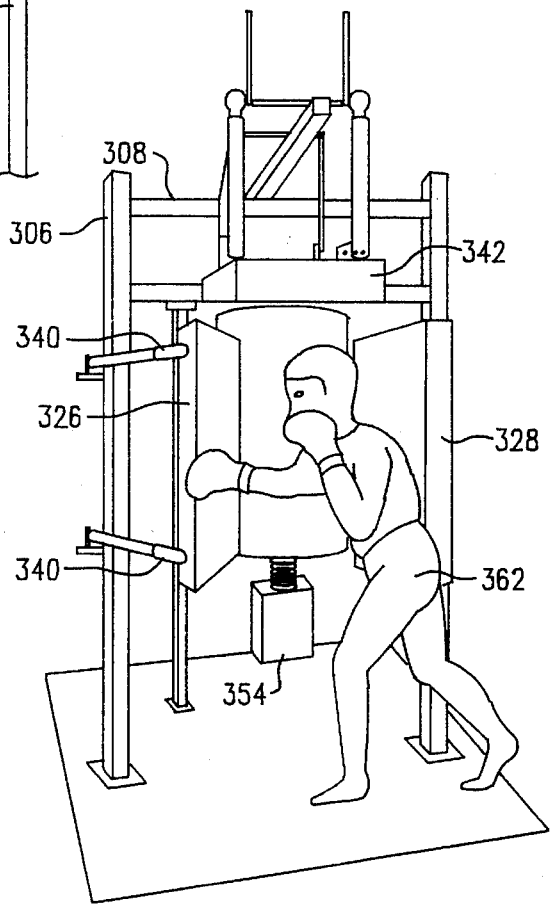
FIG. 17 is a perspective view of the speed and accuracy training apparatus first illustrated in FIG. 15, now showing an athlete in training utilizing the device.
Figure 19:
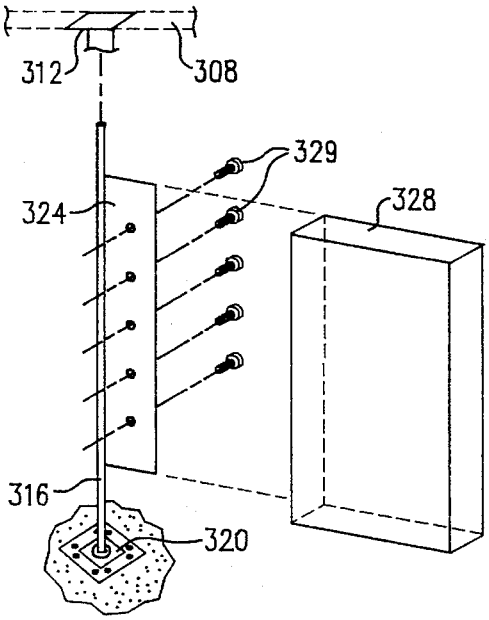
FIG. 19 is a partial exploded assembly drawing, showing the method of attachment of impact absorbing panels to a rotating member of the speed and accuracy training apparatus first illustrated in FIG. 15.

In FIG. 16, the actual mounting of the uppercut shock pad 342 is shown. Adjustment brackets 360 (front) and 362 (rear) allow repositioning of the pad 342 as necessary to suit the stature of fighter 362. A rear mounting post 364 provides needed stability, and mounting bar 366 supports mounting bars 370 and 372. The user can change the height of the uppercut pad, and can change the degree of angle of the side panels so change the degree of angle that the eft and right hooks are addressed.

Those skilled in the art will appreciate from the foregoing description that there has herein been disclosed an exemplary apparatus and method for training in the martial arts. Of course, those skilled in the art will appreciate that various modifications can be made to the exemplary apparatus and method without departing from the spirit and scope of the invention as described herein.

Therefore, it will be understood that the foregoing description of representative embodiments of the invention have been presented only for purposes of illustration and description and for providing an understanding of the invention. It is not intended to be exhaustive or to limit the invention to the precise forms disclosed. On the contrary, the intention is to cover all modifications, equivalents, and alternatives failing within the spirit and scope of the invention as expressed in the appended claims. It is therefore intended that the scope of the invention be defined by the appended claims rather than by the foregoing description; and all changes which come within the meaning and range of equivalency of the claims are therefore intended to be embraced therein.

What is claimed is:

1. An apparatus for automated training of an athlete, comprising:

a frame, a wheel means rotatably supported by the frame, a hub, an outer substantially circular wheel portion, a plurality of spokes attached to said wheel means therebetween, means for driving said wheel means, means to control the movement of said wheel means, a plurality of punching bags attached to said spokes of said wheel means, said punching bags being configured to absorb blows from said athlete, a mat, said mat located below said wheel means by a distance suitable for said athlete to engage said punching bags.

2. The training apparatus of claim 1, wherein said means to control the movement of said wheel means includes computer means.

3. The training apparatus of claim 2, wherein said computer means is provided with one or more pre-programmed, reproduceable sequence of movements for said wheel means, said sequence having a start time, a stop time, and a selected sequence of movements, or pause in movement movement, therebetween.

4. The training apparatus of claim 3, wherein said reproduceable sequence of movements includes a sequence comprising forward movement and reverse movement of said wheel means.

5. The training apparatus of claim 1, wherein said means to drive said wheel includes a variable speed drive.

6. The training apparatus of claim 5, wherein said variable speed drive further comprises an electric motor.

7. The training apparatus of claim 3, further comprising a counter display, said counter adapted to display, according to the time elapsed since initiating a pre-programmed sequence, the number of rounds elapsed in a simulated boxing match.

8. The training apparatus of claim 1, wherein at least one of said punching bags comprises a central stiff core.

9. The training apparatus of claim 8, wherein said stiff core comprises a metal pipe.

10. The training apparatus of claim 8, wherein said stiff core comprises a metal rod.

11. The training apparatus of claim 9 or claim 10, wherein said punching bag further comprises a first closed cell foam layer next to said core.

12. The training apparatus of claim 11, wherein said punching bag further comprises a plurality of air bladders adjacent to said closed cell foam layer.

13. The training apparatus of claim 12, wherein said punching bag further comprises a second closed cell foam layer outward from said air bladders.

14. The training apparatus of claim 1, wherein at lease one of said punching bags is affixed to said wheel means via spring means.

15. The training apparatus of claim 1, wherein one or more of said punching bags further comprises a punch counting system, said system adapted to count the receipt by said bag of contact from said athlete.

16. The training apparatus of claim 15, wherein said punch counting system is pneumatic, and wherein contact from said athlete transmits an air pressure signal to pneumatic receiver.

17. The training apparatus of claim 1, wherein said wheel means is suspended from said frame via bearing means.

18. The training apparatus of claim 1, further comprising stay rods means, said stay rod means radially positioned between said hub and said said circular wheel portion.

19. The training apparatus of claim 18, wherein said stay rod means further comprises an adjustable turnbuckle, so that said stay rod may be adjusted in length to true up said wheel to keep said circular wheel portion substantially circular.

* * * * *